US009040886B1

(12) United States Patent
Hopping et al.

(10) Patent No.: US 9,040,886 B1
(45) Date of Patent: May 26, 2015

(54) ADAPTIVE AERODYNAMIC CONTROL SYSTEM FOR PROJECTILE MANEUVERING

(71) Applicant: The Boeing Company, Chicago, IL (US)

(72) Inventors: Bradley M. Hopping, Florissant, MO (US); Craig R. DeMeester, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 199 days.

(21) Appl. No.: 13/889,483

(22) Filed: May 8, 2013

(51) Int. Cl.
*F42B 10/18* (2006.01)
*F42B 10/64* (2006.01)
*F42B 10/12* (2006.01)

(52) U.S. Cl.
CPC ..... *F42B 10/18* (2013.01); *F42B 10/64* (2013.01); *F42B 10/12* (2013.01)

(58) Field of Classification Search
CPC ..... F42B 10/12; F42B 10/18; F42B 10/64; B64C 3/54
See application file for complete search history.

(56) References Cited

U.S. PATENT DOCUMENTS

| | | | | |
|---|---|---|---|---|
| 3,980,257 | A * | 9/1976 | Koch et al. | 244/218 |
| 4,664,339 | A | 5/1987 | Crossfield | |
| 4,744,534 | A * | 5/1988 | Corbett | 244/218 |
| 6,224,013 | B1 | 5/2001 | Chisolm | |
| 6,250,584 | B1 | 6/2001 | Hsu et al. | |
| 6,352,217 | B1 | 3/2002 | Hsu et al. | |
| 7,410,120 | B2 | 8/2008 | Russom et al. | |
| 8,080,772 | B2 * | 12/2011 | Geck et al. | 244/3.24 |
| 8,809,755 | B1 * | 8/2014 | Patel et al. | 244/3.26 |
| 2011/0036941 | A1 * | 2/2011 | Cazals et al. | 244/46 |

* cited by examiner

*Primary Examiner* — Joseph W Sanderson
*Assistant Examiner* — Michael Kreiner
(74) *Attorney, Agent, or Firm* — Joseph M. Butscher; The Small Patent Law Gorup, LLC

(57) ABSTRACT

A projectile control system includes a plurality of fins, a drive mechanism coupled to each of the plurality of fins to enable the plurality of fins to be independently retracted or deployed, and a control mechanism in communication with the drive mechanisms to independently control the deployment or retraction of the plurality of fins. A projectile having the projectile control system and a method of operating a projectile are also described herein.

12 Claims, 6 Drawing Sheets

ADAPTIVE AERODYNAMIC CONTROL SYSTEM FOR PROJECTILE MANEUVERING

BACKGROUND

The present disclosure relates generally to control systems, and more particularly, to an adaptive aerodynamic control system for projectile maneuvering.

Aerospace vehicles, such as drones or projectiles, typically include one or more control surfaces that are coupled to, and extend outwardly from, the body of the vehicle. In operation, the control surfaces enhance or enable proper control of the vehicle. More specifically, the control surfaces are utilized to maintain the vehicle in a stable configuration along a predetermined flight path.

For example, an aerospace vehicle may be embodied as a projectile. Moreover, the control surfaces may be embodied as a plurality of fins that are fixedly coupled to an external surface of the projectile. Thus, in operation, the fins maintain the projectile in a relatively stable configuration along a predetermined flight path.

However, in operation the fixed fins do not enable the projectile to be maneuvered during flight. More specifically, because the fins are fixedly coupled to the projectile, the fins cannot be utilized to control or maneuver the projectile to either enable the projectile to deviate from the predetermined flight path or to reacquire the flight path when the projectile deviates from the predetermined flight path. Moreover, the fixed fins may increase drag on the projectile which may reduce the energy of the projectile. The reduced energy may cause the projectile to have a reduced operational range or a reduced effect. Therefore, projectiles having fixed fins may be limited in range causing a further reduction in the projectiles performance. As a result, the fixed fins do not enable the projectile to be maneuvered along the predetermined flight path. Additionally, the fixed fins may change the aerodynamics of the projectile, which may cause a decrease in the projectiles range and/or performance.

SUMMARY

In accordance with one embodiment, a projectile control system is provided that includes a plurality of fins, a drive mechanism coupled to the plurality of fins to enable the plurality of fins to be retracted or deployed, and a control mechanism in communication with the drive mechanism to independently control the deployment or retraction of the plurality of fins.

In accordance with another embodiment, a projectile is provided. The projectile includes a projectile control system. The projectile control system includes a plurality of fins, a drive mechanism coupled to the plurality of fins to enable the plurality of fins to be retracted or deployed, and a control mechanism in communication with the drive mechanism to independently control the deployment or retraction of the plurality of fins.

In accordance with a further embodiment, a method of operating a projectile that includes a plurality of fins and a drive mechanism coupled to each of the plurality of fins is provided. The method includes receiving a flight path input at a projectile, analyzing the flight path input and independently retracting or deploying at least one of fins to maintain the projectile on the flight path.

The features and functions discussed herein can be achieved independently in various embodiments or may be combined in yet other embodiments, further details of which can be seen with reference to the following description and drawings.

DETAILED DESCRIPTION

Figure 1:
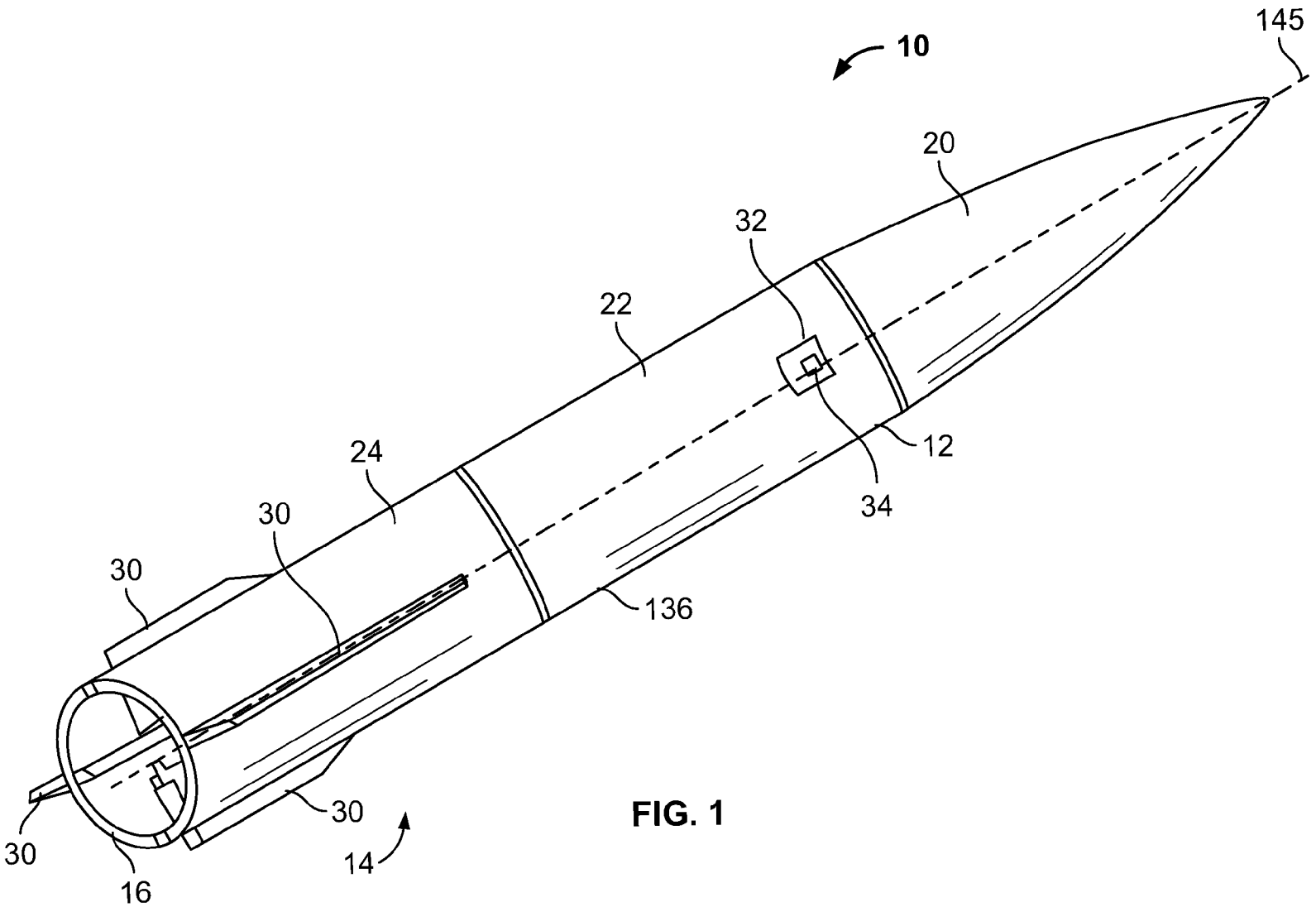
FIG. 1 is a perspective view of an exemplary projectile in accordance with one embodiment.

The following detailed description of certain embodiments will be better understood when read in conjunction with the appended drawings. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments described and/or illustrated herein provide methods and systems for incrementally retracting or deploying a plurality of fins coupled to a projectile. For example, some embodiments provide a projectile control system that enables the fins to be extended outwardly from the projectile, referred to herein as deployed, or extend inwardly into the projectile, referred to herein as retracted. The fins may be positioned at a plurality of positions between fully retracted and fully deployed. In the fully retracted position the fins are substantially enclosed within the body of the projectile. In the fully deployed position the fins are fully extended from the projectile body. Enabling the fins to be repositioned between fully retracted and fully deployed enables the projectile to be maneuvered along a predetermined flight path. More specifically, repositioning the fins enables a lift of the projectile to be changed and thus enables the projectile to be maneuvered without a resultant increase in drag. Thus, the various embodiments described herein modulate a surface area of the fins exposed enabling the projectile to achieve improved or optimal performance during a wide variety of flight conditions.

Although various embodiments are described with respect to a projectile, it should be realized that the various embodiments described herein may be utilized with any aerospace vehicle and the projectile represents one such aerospace vehicle. It should further be appreciated that although an aerospace application is described herein, the various embodiments are not limited to aerospace applications, but the methods and systems described herein may be used in non-aerospace applications. For example, the various embodiments may be used in various land, sea and space applications. As used herein, a projectile is any object that may be projected into space by the exertion of a force. Moreover, the projectile may be a manned or unmanned projectile.

In various embodiments, a projectile 10 may be provided as illustrated in FIG. 1. In one embodiment, the projectile 10 includes a fuselage 12 and a projectile control system 14 that is coupled to, or formed integrally with, the fuselage 12. The fuselage 12 is generally formed as a tubular structure having a hollow portion or cavity 16 defined therein. In one embodiment, the fuselage 12 may be fabricated to include a nose portion, 20, a body portion 22, and a tail portion 24. The fuselage 12 may be fabricated as a unitary structure that includes the nose portion, 20, the body portion 22, and the tail portion 24. Optionally, the nose portion, 20, the body portion 22, and the tail portion 24 may be fabricated separately as individual or unitary components and assembled to form the fuselage 12.

As described above, the projectile 10 also includes the projectile control system 14. The projectile control system 14 includes a plurality of fins 30. The projectile control system 14 also includes various other components or devices to control the operation of the fins 30. In the exemplary embodiment, the projectile control system 14 is fabricated as a separate stand-alone component that may then be installed into the projectile 10 during the projectile assembly process.

The projectile 10 also includes a control mechanism 32. In various embodiments, the control mechanism may be embodied as a computer or processor that is configured to control the operation of the projectile control system 14 and various other components within the projectile 10. In operation, the control mechanism 32 receives inputs from various sensors and/or user inputs to facilitate controlling the operation of the projectile control system 14 and thus control the positioning of the fins 30.

The control mechanism 32 may be connected to the projectile control system 14 via a communication bus (not shown). The control mechanism 32 may include a memory 34 for storing, for example, a predetermined flight plan. The memory 34 may include Random Access Memory (RAM) and Read Only Memory (ROM). The control mechanism 32 may also include a storage device (not shown), which may be a hard disk drive or a removable storage drive such as a solid state drive, optical disk drive, and the like. The storage device may also be other similar means for loading computer programs or other instructions into the control mechanism 32.

In operation, the processor executes a set of instructions, such as the predetermined flight plan, that are stored in one or more storage elements, in order to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments described herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Figure 2:
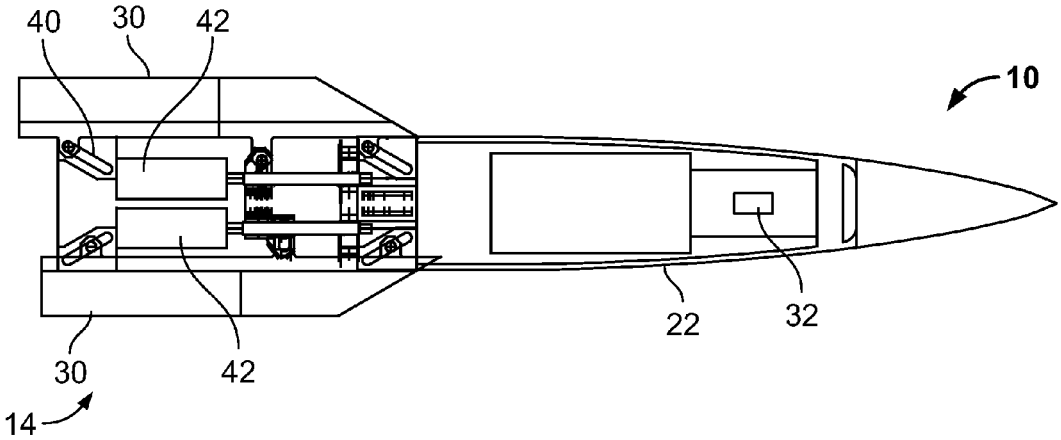
FIG. 2 is a perspective view of the projectile with the fuselage removed to illustrate a projectile control system in accordance with one embodiment.
Figure 3:
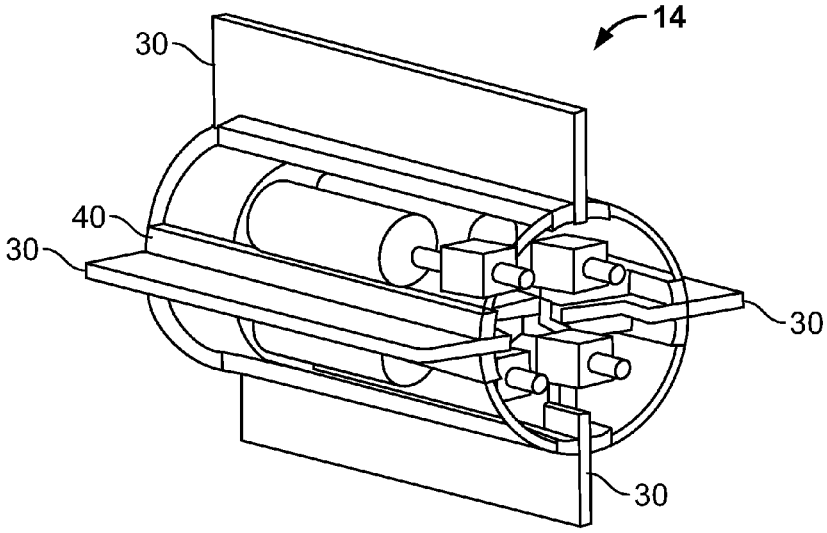
FIG. 3 is a perspective view of a portion of the projectile control system shown in FIG. 2 in accordance with one embodiment.
Figure 4:
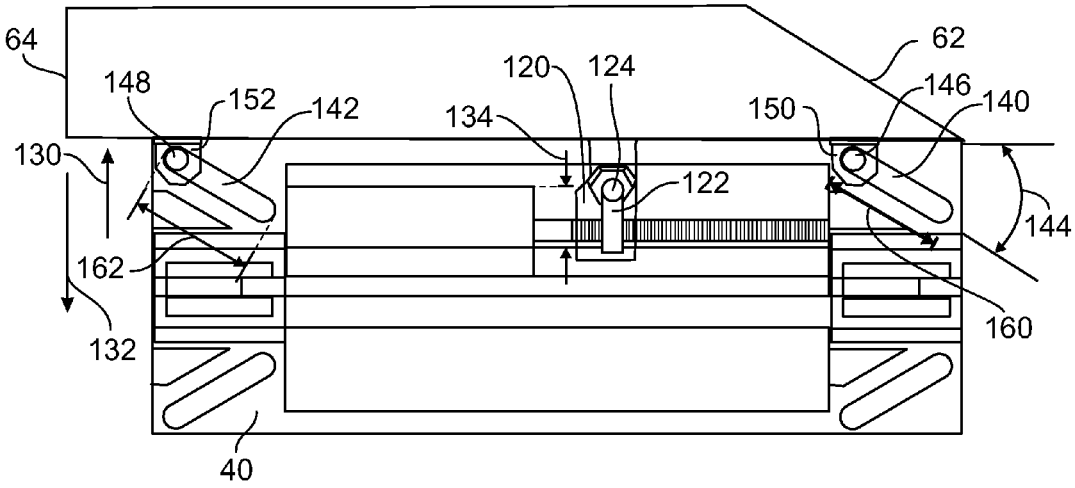
FIG. 4 is a side cutaway view of a portion of the projectile control system shown in FIG. 2 in accordance with one embodiment.

FIG. 2 is a perspective view of the projectile 10 with the fuselage 12 removed to illustrate the projectile control system 14. FIG. 3 is a perspective view of a portion of the projectile control system 14. FIG. 4 is a side cutaway view of a portion of the projectile control system 14. As described above the projectile control system 14 also includes a plurality of fins 30. The projectile control system 14 includes a substructure 40. In various embodiments, the substructure 40 has a substantially cylindrical shape to enable the substructure 40, and the various components installed therein, to be installed within the projectile 10. More specifically, the substructure 40 provides a platform for installing the fins 30 and various other components described in more detail below, prior to the projectile control system 14 being installed in the projectile 10.

In various embodiments, the projectile control system 14 includes N fins 30 that may each be operated independently from the other fins 30. More specifically, each individual fin 30 may be repositioned, i.e. fully deployed, fully retracted, or a plurality of positions between fully deployed and fully retracted, without affecting the position of the other fins 30. Accordingly, to reposition the fins 30, the projectile control system 14 further includes a plurality of drive mechanisms 42. In various embodiments, the projectile control system 14 includes N drive mechanisms 42 such that each of the N drive mechanisms 42 is coupled to, and is configured to, reposition a single respective fin 30. The configuration and operation of the drive mechanisms 42 are described in more detail below.

Figure 5:
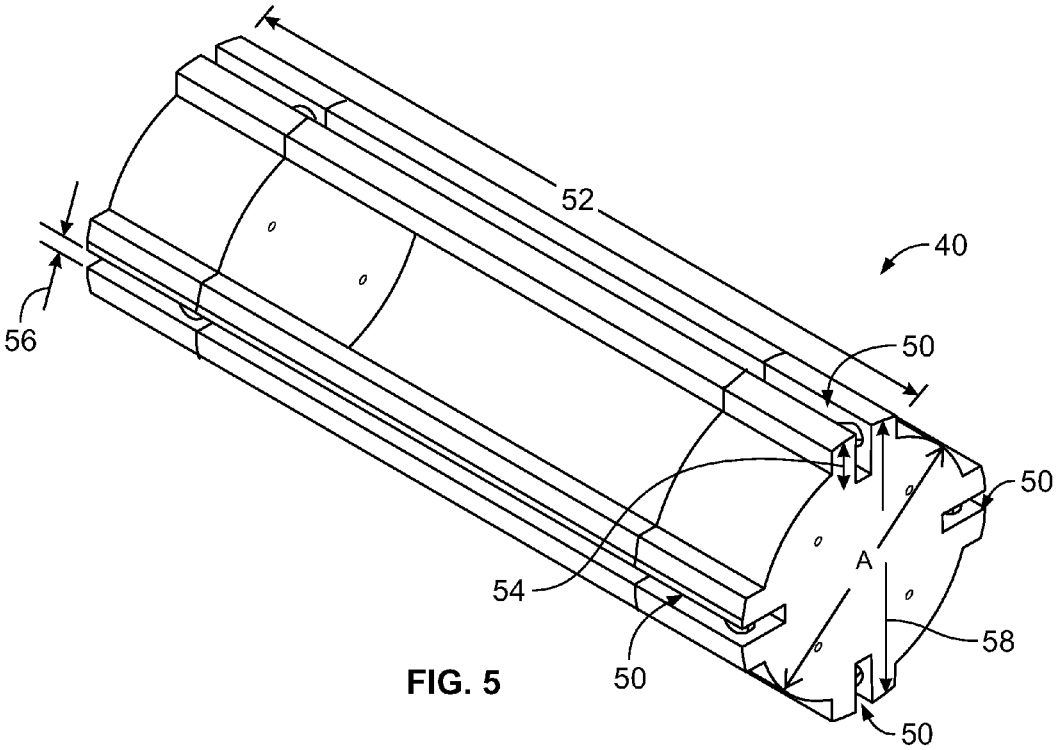
FIG. 5 is a perspective view of the substructure shown in FIG. 4 in accordance with one embodiment.
Figure 6:
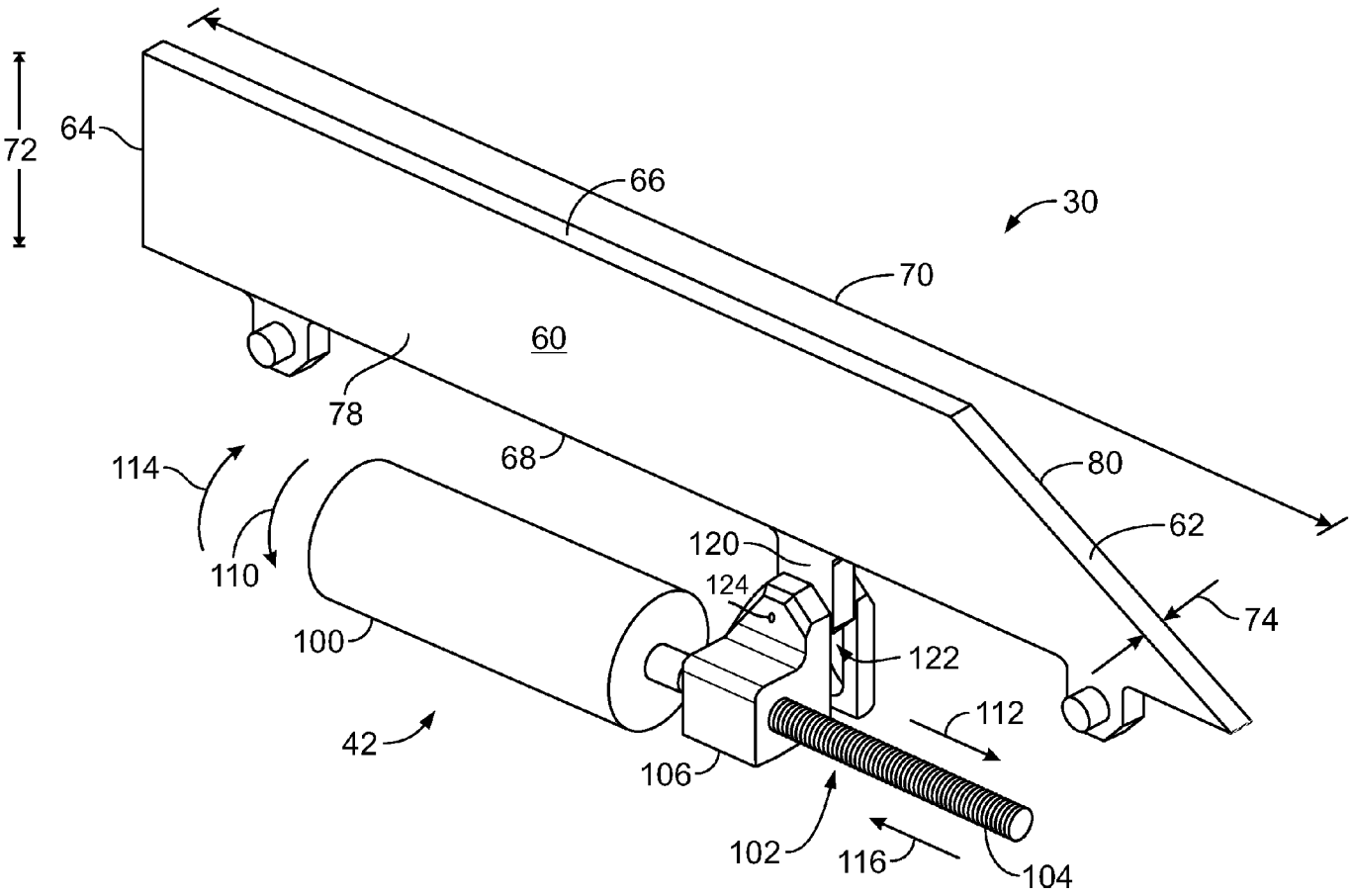
FIG. 6 is a perspective view of the drive mechanism shown in FIGS. 2-4 in accordance with one embodiment.

FIG. 5 is a perspective view of the substructure 40 shown in FIGS. 2-4. In various embodiments, the substructure 40 includes N fin slots 50. In operation, each of the N fin slots 50 is configured to receive a single fin 30 therein as shown in FIGS. 2-4. In various embodiments, each of the N fin slots 50 has a length 52, a depth 54, and a width 56. In operation, the length 52, the depth 54, and the width 56 of the fin slots 50 are each sized to receive a single fin 30 therein. For example, FIG. 6 is a perspective view of one of the fins 30 that may be installed in one of the N fin slots 50. In various embodiments, the fin 30 has a body 60 that is defined by a leading edge 62, a trailing edge 64, a tip chord 66, and a root chord 68. Moreover, the body 60 has a length 70 that extends from the distal end of the leading edge 62 to the distal end of the trailing edge 64. The body 60 also has a width 72 that extends from the tip chord 66 to the root chord 68. Additionally, the body 60 has a thickness 74 that extends from a first side 78 of the body 60 to an opposing second side 80 of the body 60.

Referring again to FIG. 5, as described above each of the fins 30 is configured to be received within a respective slot 50. Accordingly, the length 52 of the slots 50 is substantially similar to the length of 70 of the fins 30, the depth 54 of the slots 50 is substantially similar to the width 72 off the fins 30, and the width 56 of each of the slots 50 is substantially similar to the thickness 74 of the fins 30. It should be realized that the fins 30 are configured to be extended or retracted from the slots 50. Accordingly, the length 52, the depth 54, and the width 56 of the slots 50 is slight larger than the corresponding the length 70, width 72, and the thickness of the fins 30 to enable each of the fins 30 to be movable into and out of the slots 50 without binding. In various embodiments, the substructure 40 has an outer diameter 58 that is sized slightly smaller than an inner diameter of the fuselage 12 to enable the assembled projectile control system 14 to be installed within the fuselage 12 during assembly of the projectile 10.

Referring again to FIG. 6, as described above, each of the fins 30 is coupled to, and repositioned, using a single drive mechanism 42. Accordingly, although FIG. 6 illustrates a single drive mechanism 42 that may be coupled to a single fin 30, it should be realized that the projectile 10 includes N fins 30 that are each operated using a respective drive mechanism 42 to enable each fin 30 to be independently controlled.

In the illustrated embodiment, the drive mechanism 42 includes a motor 100 that is coupled to a linear actuator 102. The linear actuator 102 may be implemented, for example, as a ball screw device or a lead screw device. In the illustrated embodiment, the linear actuator 102 is embodied as a ball screw device that includes a threaded drive shaft 104 and a yoke 106 that is threadably coupled to the drive shaft 104. In operation, the linear actuator 102 operates to convert the rotational motion of the motor 100 to linear motion via the drive shaft 104. Thus, as the motor 100 is rotated in a first direction 110, the yoke 106 is driven in a first axial direction 112. Moreover, as the motor 100 is rotated in a second direction 114, the yoke 106 is moved in a second opposite axial direction 116. Therefore, it should be realized that operating the motor 100 causes the yoke 106 to move along the drive shaft 104 in either axial direction 112 or 116.

As described above, the drive mechanism 42 is configured to reposition the fin 30. Accordingly, to couple the fin 30 to the drive mechanism 42, the fin 30 includes a tab 120 that has an opening (not shown) defined therethrough. As shown in FIG. 6, the tab 120 is coupled to the root chord 68 of the fin 30. The tab 120 may be formed as a separate structure that is coupled to the fin 30, via a welding procedure, for example. In the illustrated embodiment, the tab 120 is configured to be received within a first pair of guide slots 122 formed in the yoke 106. The fin 30 may then be coupled to the yoke 106 using a first pair of guide pins 124 as shown in FIG. 6.

Referring again to FIG. 4, as described above, the fin 30 is coupled to the yoke 106 via the first pair of guide pins 124. More specifically, the first pair of guide pins 124 are inserted into the first pair of guide slots 122 to enable the fin 30 to be moved via the drive shaft 104. In the exemplary embodiment, the guide pins 124 move freely within the guide slots 122 such that when the drive shaft 104 is operated the guide pins 124 move freely within the guide slots 122 along a radially outward direction 130 to extend the fin 30 or move freely within the guide slots 122 along a radially inward direction 132 to retract the fin 30. More specifically, the combination of the guide pins 124 and the guide slots 122 enable the fin 30 to be extended outwardly from the projectile 10 or retracted into the projectile 10. Accordingly, the first pair of guide slots 122 are positioned approximately perpendicular to the drive shaft 104. Moreover, the first pair of guide slots 122 have a length 134 that is sized to enable the fin 30 to be fully retracted within the projectile 10 such that the tip chord 66 is approximately flush with an exterior surface 136 (shown in FIG. 1) of the projectile 10. Moreover, the first pair of guide slots 122 has a length 134 that enables the fin 30 to be fully extended from the projectile 10 such that the root chord 68 of the fin 30 is substantially flush with the exterior surface 136 of the projectile 10. It should be realized that the first pair of guide slots 122 enable the fin 30 to be moved radially inwardly and outwardly from the projectile 10 and also function to maintain an axial position of the fin 30 via the coupling between the fin 30 and the yoke 106.

In various embodiments, and referring to FIG. 4, the substructure 40 also includes a second pair of guide slots 140 and a third pair of guide slots 142. In operation, the second and third pairs of guide slots 140 and 142 are configured to enable the fin 30 to move at a predetermined angle 144 with respect to a centerline 145 of the projectile 10 (shown in FIG. 1) to maintain a predetermined aeroload on the fin 30 while the projectile 10 is in flight. The predetermined angle 144 of the second and third pairs of guide slots 140 and 142 is described in more detail below.

As described above, the drive mechanism 42 is configured to reposition the fin 30 in an axial direction. Thus, the combination of the first pair of guide slots 122 and the first pair of guide pins 124 function to move, and/or maintain, the fin 30 in the axial direction. Moreover, the second and third pair of guide slots 140 and 142 function to move the fin 30 along the predetermined angle 144. Thus, the fin 30 also includes a second pair of guide pins 146 and a third pair of guide pins 148. In various embodiments, the second pair of guide pins 146 are each coupled proximate to the leading edge 62 of the fin 30 and the third pair of guide pins 148 are coupled proximate to the trailing edge 64 of the fin 30. During assembly, the second pair of guide pins 146 are inserted into the second pair of guide slots 140. Additionally, the third pair of guide pins 148 are inserted into the third pair of guide slots 142. In various embodiments, the second pair of guide pins 148 may be coupled to the fin 30 via a second tab 150 and the third pair of guide pins 148 may be coupled to the fin 30 via a third tab 152.

Thus, the combination of the second and third pairs of guide pins 146 and 148 enable the fin 30 to move along the predetermined angle 144 while positioned within the second and third pairs of guide slots 140 and 142, respectively.

In the exemplary embodiment, the second pair of guide slots 140 has a length 160 that is sized to enable the fin 30 to be fully retracted within the projectile 10 such that the tip chord 66 is approximately flush with an exterior surface 136 (shown in FIG. 1) of the projectile 10. Moreover, the length 160 of the second pair of guide slots 140 is sized to enable the fin 30 to be fully extended from the projectile 10 such that the root chord 68 of the fin 30 is substantially flush with the exterior surface 136 of the projectile 10. Additionally, the third pair of guide slots 142 has a length 162 that is sized to enable the fin 30 to be fully retracted within the projectile 10 such that the tip chord 66 is approximately flush with an exterior surface 136 (shown in FIG. 1) of the projectile 10. Moreover, the length 162 of the third pair of guide slots 142 is sized to enable the fin 30 to be fully extended from the projectile 10 such that the root chord 68 of the fin 30 is substantially flush with the exterior surface 136 of the projectile 10. Accordingly, it should be realized that the second and third pairs of guide slots 140 and 142 enable the fin 30 to be moved radially inwardly and outwardly from the projectile 10 along the predetermined angle 144.

The overall operation of the projectile control system 14 is now described. As described above, the controllable deployable fins 30 may be retracted into, or deployed outwardly from the projectile 10, to enable the projectile 10 to be maneuvered in flight. Thus, the projectile control system 10 provides an efficient means to steer or maneuver the projectile 10 because all of the fins 30 are individually controllable. Thus, by individually controlling the position of the fins 30, the projectile 10 may be steered up, down, side-to-side, etc. Moreover, the individually controlled fins 30 enable the projectile to perform banking or other maneuvers to enable the projectile 10 be steered or maneuvered similar to a plane, for example.

More specifically, while the projectile control system 14 enables the fins 30 to be moved into or out of the fuselage 12, the projectile control system 14 also enables the surface area of the fins 30 exposed to be controlled thus controlling the base aerodynamics of the projectile 10. For example, by moving the fins 30 into or out of the fuselage 12, the projectile control system 14 is enabled to change or modify the drag on the projectile 10 in flight. Therefore, controlling the drag of the projectile 10 enables the projectile 10 to initiate a steering maneuver and also increases the stability of the projectile 10 during flight.

Figure 7:
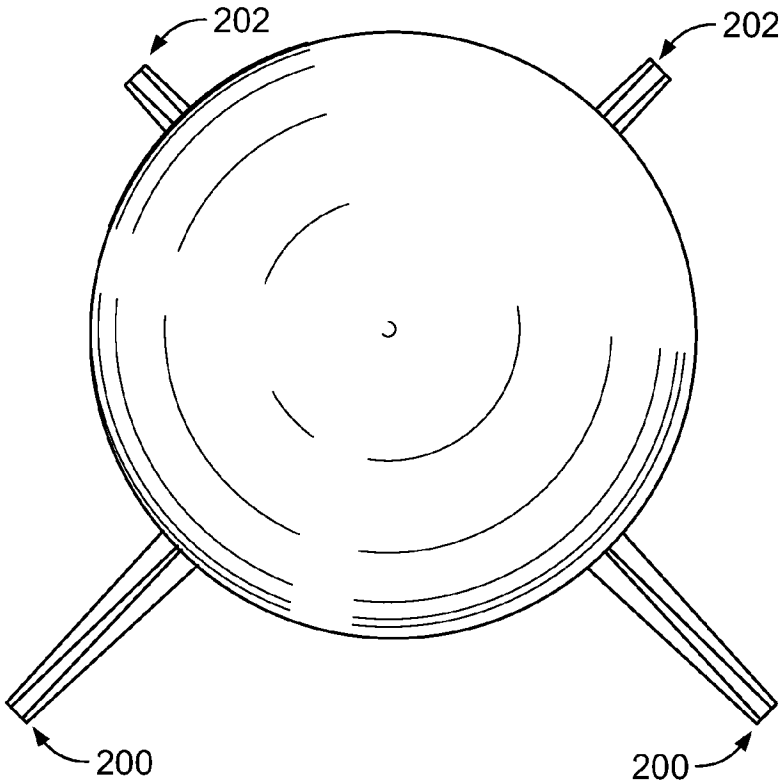
FIG. 7 is a perspective view of the projectile wherein the fins are positioned at a first operational position in accordance with one embodiment.

In various embodiments, the fins 30 are fully retractable such that the fins 30 do not extend from the fuselage 12. Moreover, the fins are fully extendable such that the fins 30 extend outwardly from the fuselage 12. Additionally, the fins 30 may be positioned at a plurality of positions between fully extracted and fully extended to increase maneuverability and/or increase stability. The fins 30 may therefore be positioned at a plurality of positions between fully extended and fully retracted which may be incremental or continuous. For example, as shown in FIG. 7, a pair of fins 200 may be fully extended and a second pair of fins 202 may be partially extended.

Figure 8:
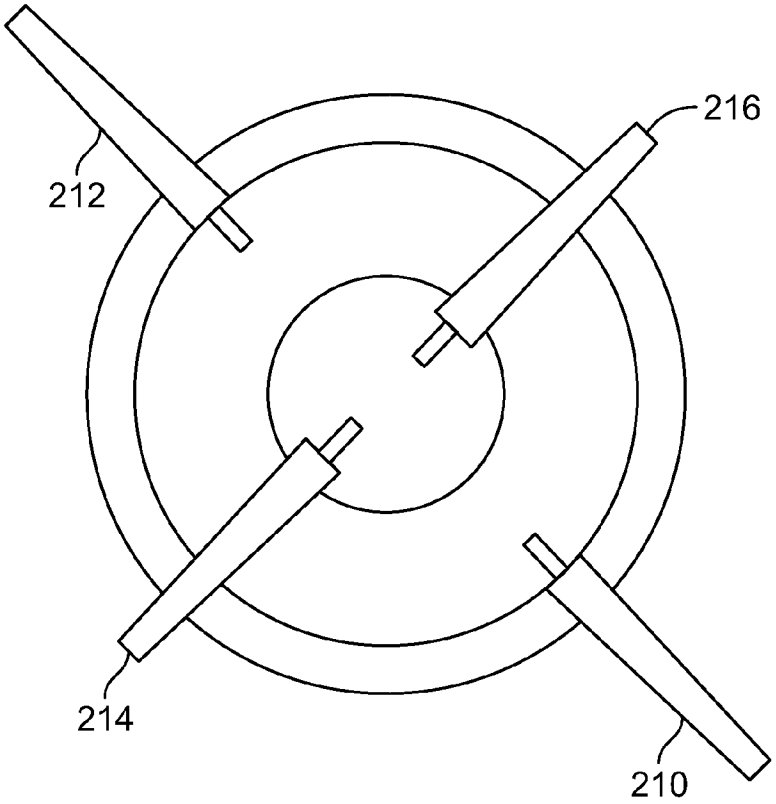
FIG. 8 is a perspective view of the projectile wherein the fins are positioned at a second operational position in accordance with one embodiment.

It should be realized that because the fins 30 are individually controllable, the projectile control system 14 may also be utilized to modify the pitch stability or yaw of the projectile 10. For example, and referring to FIG. 8, modifying the position, i.e. either extending or retracting, a pair of parallel fins, such as the fins 210 and 212 enables the projectile control system 14 to modify the pitch stability of the projectile. Whereas, modifying a position of a second pair of parallel fins, such as the fins 214 and 216, may enable the projectile control system 14 to modify the yaw stability of the projectile 10. Moreover, retracting a fin, such as the fin 216 enables the projectile control system 14 to pitch the nose 20 of the projectile 10 up. Whereas, retracting the fin 214 enables the projectile control system 14 to pitch the nose 20 down. Accordingly, one set of fins 30 may be used to change the pitch of the projectile 10 whereas a second set of fins 30 may be used to change the yaw of the projectile 10 from side to side. The adaptive controllable fins 30 therefore increases the stability of the projectile 30 by enabling the nose 20 to move up or down and maintain a stable platform.

As described above, the fins 30 are positioned within the second and third pair of guide slots 140 and 142. Moreover, the second and third pair of guide slots 140 and 142 are formed at a predetermined angle 144 to enable the fin 30 to move along the predetermined angle when being extended and/or retracted. In the exemplary embodiment, the predetermined angle 144 is approximately perpendicular to a resultant aero load on the fins 30. For example, assume that the maximum aero load on the fins 30 is determined to occur when the fins 30 are positioned at 60 degrees with respect to the centerline axis 145 of the projectile 10. Accordingly, in the exemplary embodiment described, the predetermined angle 144 of the second and third pair of guide slots 140 and 142 is 30 degrees. By placing the second and third pair of guide slots 140 and 142 at 30 degrees, i.e. approximately perpendicular to the maximum aero load on the fins 30, the torque on the fins 30 occurring in flight is transferred to the fuselage 12. Moreover, because the torque is transferred to the fuselage 12, the drive mechanisms 42 are not required to overcome the torque on the fins 30. As a result, the size of the drive mechanisms 42 may be reduced because of the reduction in torque used to either extend or retract the fins. For example, the drive mechanism 42 may be operated using a relatively small motor 100 and thus the system may consume less energy which increases the projectiles range.

Additionally, the projectile control system 14 may be fabricated as a stand-alone component that is installed in the projectile 10 during the assembly process. As a result, the substructure 40 provides a platform to assemble both the fins 30 and the drive mechanisms 42 prior to the assembled projectile control system 14 being installed in the projectile 10. As a result, the compact configuration of the fins 30 and the drive mechanisms 42 within the substructure 40 enable the projectile control system 14 to be utilized with a wide variety of projectiles.

Figure 9:
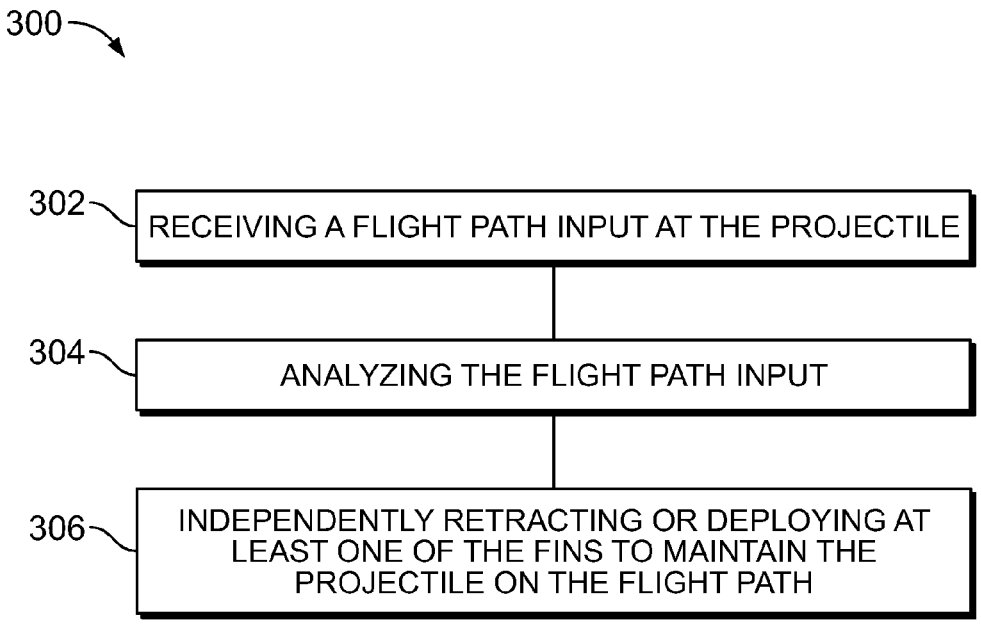
FIG. 9 is a flowchart of a method of operating a projectile in accordance with one embodiment.

FIG. 9 is a flowchart of a method 300 of operating a projectile, such as the projectile 10 shown in FIG. 1. In various embodiments, the method 300 includes receiving 302 a flight path input at the projectile, analyzing 304 the flight path input and independently retracting or deploying 306 at least one of fins to maintain the projectile on the flight path. In various embodiments, the fins may be deployed or retracted using the projectile control system 14 described above. Moreover, the fins 30 may be operated in independently to incrementally deployed or retract one of the fins 30, or two or more of the fins 30.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from the scope thereof. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A projectile control system comprising:

a substructure;

a plurality of fins;

a drive mechanism coupled to each of the plurality of fins to enable the plurality of fins to be independently retracted or deployed, wherein the drive mechanism includes a motor coupled to the substructure, a drive shaft coupled to the motor, and a yoke coupled between a fin of the plurality of fins and the drive shaft, wherein the yoke comprises a first pair of guide slots and the fin comprises a first pair of guide pins configured to be inserted into the first pair of slots, the first pair of slots configured to enable the fin to move radially inward and outward from the drive shaft; and a control mechanism in communication with the drive mechanisms to independently control the deployment or retraction of the plurality of fins.

2. The projectile control system of claim 1, wherein the drive mechanism is configured to incrementally deploy or retract the plurality of fins.

3. The projectile control system of claim 1, wherein the drive mechanism is configured to incrementally deploy or retract the plurality of fins along a predetermined angle.

4. The projectile control system of claim 1, wherein the drive mechanism is configured to incrementally deploy or retract the plurality of fins along a predetermined angle that is approximately perpendicular to a maximum aero load on the fins.

5. The projectile control system of claim 1, further comprising a second pair of guide slots and a third pair of guide slots, at least one of the plurality of fins including a second pair of guide pins configured to translate within the second pair of guide slots and a third pair of guide pins configured to translate within the third pair of guide slots.

6. The projectile control system of claim 5, wherein the second and third pairs of guide slots are disposed at a predetermined angle that is approximately perpendicular to a maximum aero load on the fins.

7. A projectile comprising:

a fuselage; and a projectile control system coupled to the fuselage, the projectile control system including:

a substructure;

a plurality of fins;

a drive mechanism coupled to each of the plurality of fins to enable the plurality of fins to be independently retracted or deployed, the drive mechanism including a motor coupled to the substructure, a drive shaft coupled to the motor, and a yoke coupled between a fin in the plurality of fins and the drive shaft, wherein the yoke comprises a first pair of guide slots and the fin comprises a first pair of guide pins configured to be inserted into the first pair of slots, the first pair of slots configured to enable the fin to move radially inward and outward from the drive shaft; and a control mechanism in communication with the drive mechanisms to independently control the deployment or retraction of the plurality of fins.

8. The projectile of claim 7, wherein the drive mechanism is configured to incrementally deploy or retract the plurality of fins along a predetermined angle.

9. The projectile of claim 7, wherein the drive mechanism is configured to incrementally deploy or retract the plurality of fins along a predetermined angle that is approximately perpendicular to a maximum aero load on the fins.

10. The projectile of claim 7, wherein the drive shaft is operable in a first direction to deploy the fin and operable in a second opposite direction to retract the fin.

11. The projectile of claim 7, wherein the projectile control system further comprises a second pair of guide slots and a third pair of guide slots, the fin including a second pair of guide pins configured to translate within the second pair of guide slots and a third pair of guide pins configured to translate within the third pair of guide slots.

12. The projectile of claim 11, wherein the first and second pairs of guide slots are disposed at a predetermined angle that is approximately perpendicular to a maximum aero load on the fins.

* * * * *